US006159038A

United States Patent [19]

Wu

[11] Patent Number: 6,159,038

[45] Date of Patent: Dec. 12, 2000

[54] COMPRESSION HEADER CONNECTOR HAVING STRAIN RELIEF AND MOUNTABLE TO FRAME OF HARD DISK DRIVE

[75] Inventor: Jerry Wu, Chang-Hua, Taiwan

[73] Assignee: Hon Hai Precision Ind. Co., Ltd., Taipei Shien, Taiwan

[21] Appl. No.: 09/296,109

[22] Filed: Apr. 21, 1999

[51] Int. Cl.[7] ..... H01R 12/24

[52] U.S. Cl. ..... 439/495; 439/926

[58] Field of Search ..... 439/495, 76.1, 439/926

[56] References Cited

U.S. PATENT DOCUMENTS

| | | | |
|---|---|---|---|
| 4,811,165 | 3/1989 | Currier et al. | 439/76.1 |
| 5,187,643 | 2/1993 | I-Shou | 439/76.1 |
| 5,370,552 | 12/1994 | Chishima et al. | 439/495 |
| 5,816,845 | 10/1998 | Chishima et al. | 439/495 |

*Primary Examiner*—Neil Abrams
*Assistant Examiner*—Javaid Nasri
*Attorney, Agent, or Firm*—Wei Te Chung

[57] ABSTRACT

A ZIF compression header connector comprises a housing having lower and upper faces. A plurality of terminal cells is defined between the lower and upper faces. At least a retaining wedge is formed on an outer wall of the housing. An elongate slot is formed in the upper face. A plurality of terminals is assembled in the corresponding terminal cells. Each terminal includes a base portion retained within the terminal cell, a first spring arm extending into the elongate slot, and a second spring arm extending downward for electrically contacting a conductive pad. A plunger is assembled to the housing for urging an inserted FFC against the first spring arms of the terminals. The plunger has a retaining bar for detachably securing to the housing to provide a strain relief function.

9 Claims, 4 Drawing Sheets

COMPRESSION HEADER CONNECTOR HAVING STRAIN RELIEF AND MOUNTABLE TO FRAME OF HARD DISK DRIVE

FIELD OF THE INVENTION

The present invention relates to a compression header connector, and more particularly to a ZIF compression header connector.

DESCRIPTION OF THE PRIOR ART

Conventionally, a cable assembly used with a hard disk drive includes a header connector having an FPC soldered thereto. The header connector is then assembled to a printed circuit board within the hard disk drive by a screw and nut arrangement. Soldering the FPC to the header connector and the FPC increases costs. In addition, no strain relief is provided in the conventional cable assembly.

SUMMARY OF THE INVENTION

An objective of this invention is to provide a compression header connector having a strain relief.

Another objective of this invention is to provide a compression header connector having a plunger for facilitating electrical connection between terminals within a header and an inserted FPC.

In order to achieve the objective set forth, a compression header connector in accordance with the present invention comprises a housing having lower and upper faces. A plurality of terminal cells is defined between the lower and upper faces. At least a retaining wedge is formed on an outer wall of the housing. An elongate slot is formed in the upper face. A plurality of terminals is assembled in the corresponding terminal cells. Each terminal includes a base portion retained within the terminal cell, a first spring arm extending into said elongate slot, and a second spring arm extending downward for electrically contacting a conductive pad. A plunger is assembled to said housing for urging an inserted FPC against the first spring arms of the terminals.

According to one aspect of the present invention, at least a retaining wedge is formed on an outer wall of the housing for facilitating assembly of the header connector to a frame of a hard disk drive.

According to another aspect of the present invention, a strain relief is formed on a plunger thereby eliminating improper connection between the inserted FPC and the terminals.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENT

Figure 1:
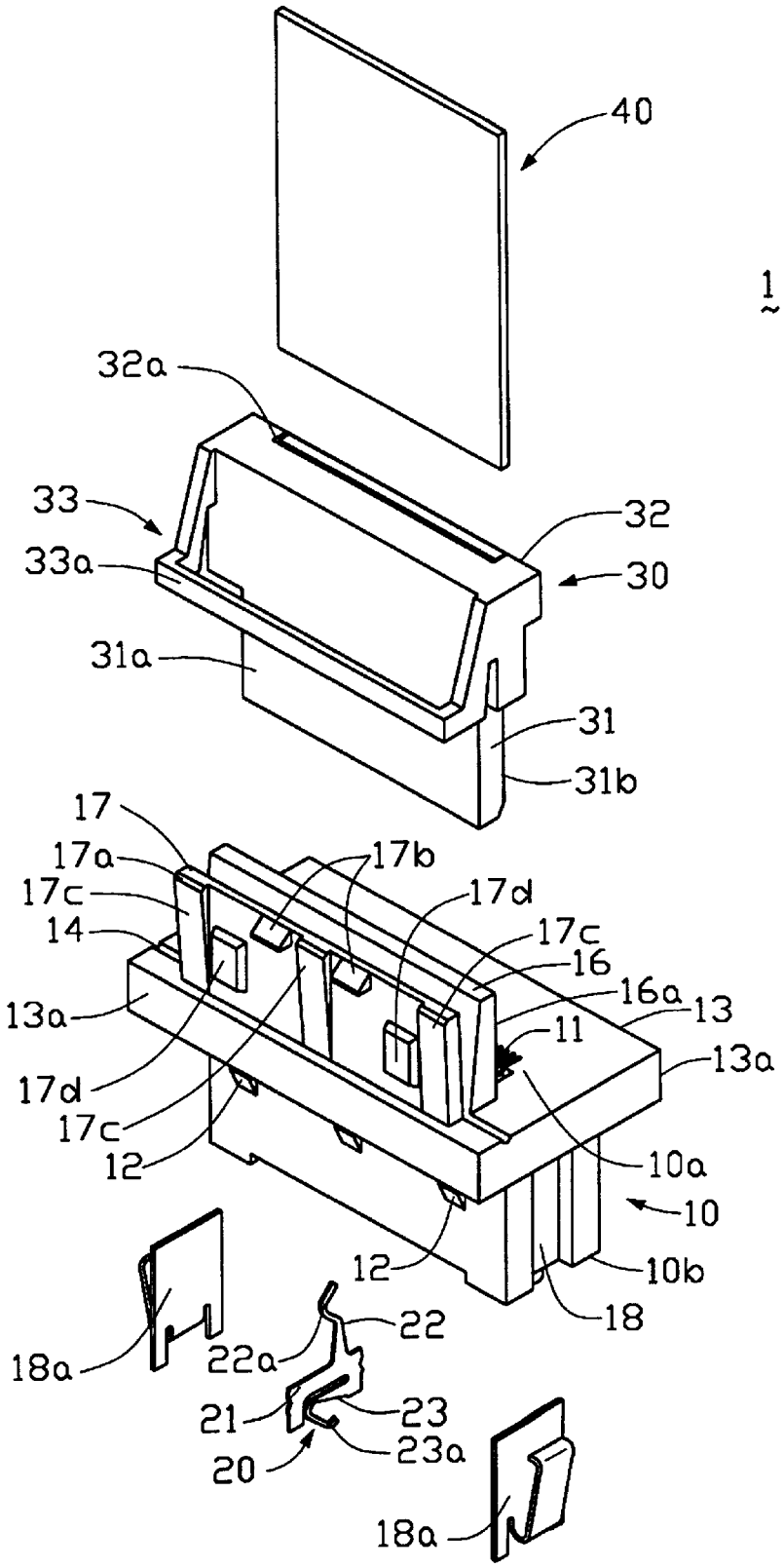
FIG. 1 is an exploded view of a compress header connector in accordance with the present invention.
Figure 2A:
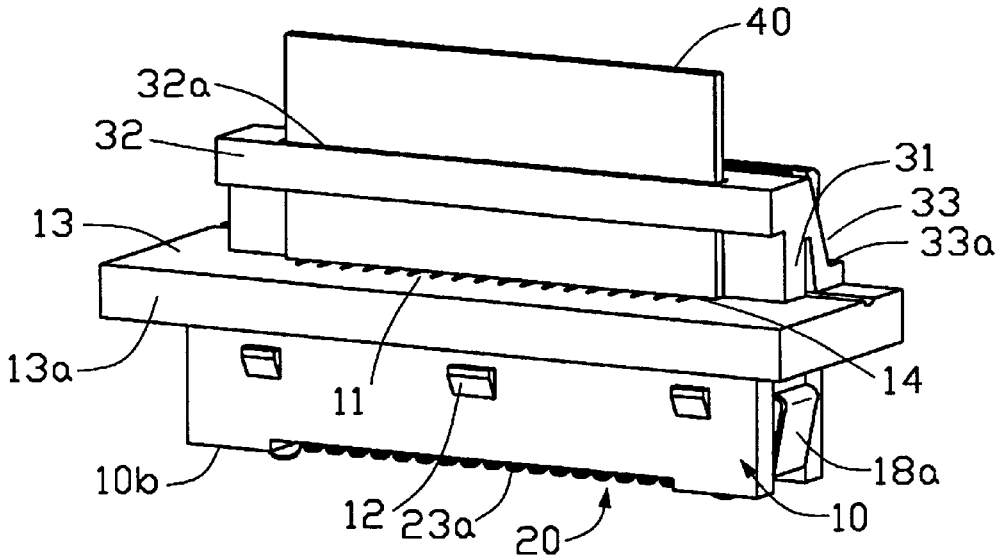
FIG. 2A is an assembled view of FIG. 1.
Figure 2B:
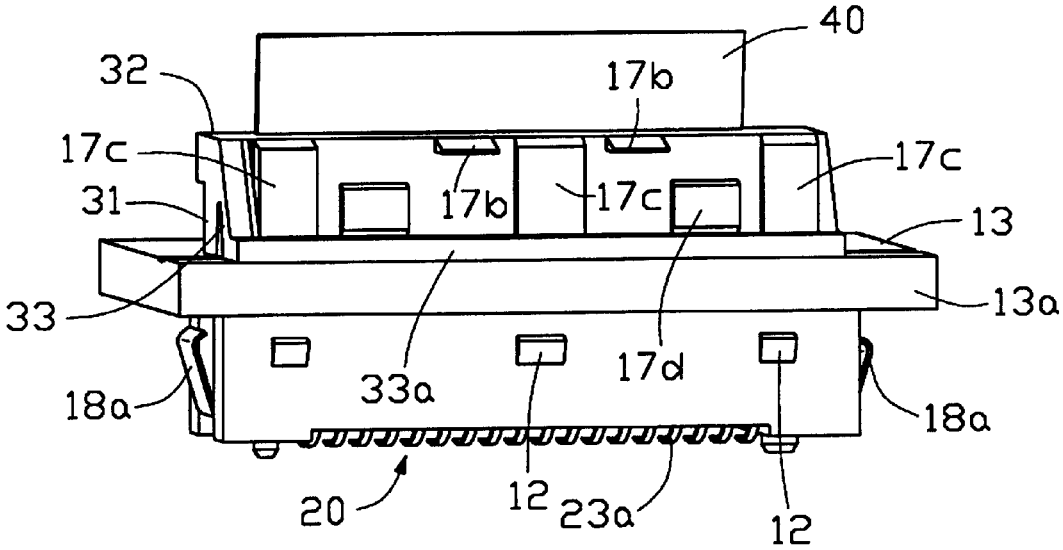
FIG. 2B is similar to FIG. 2A taken from a different perspective.
Figure 3B:
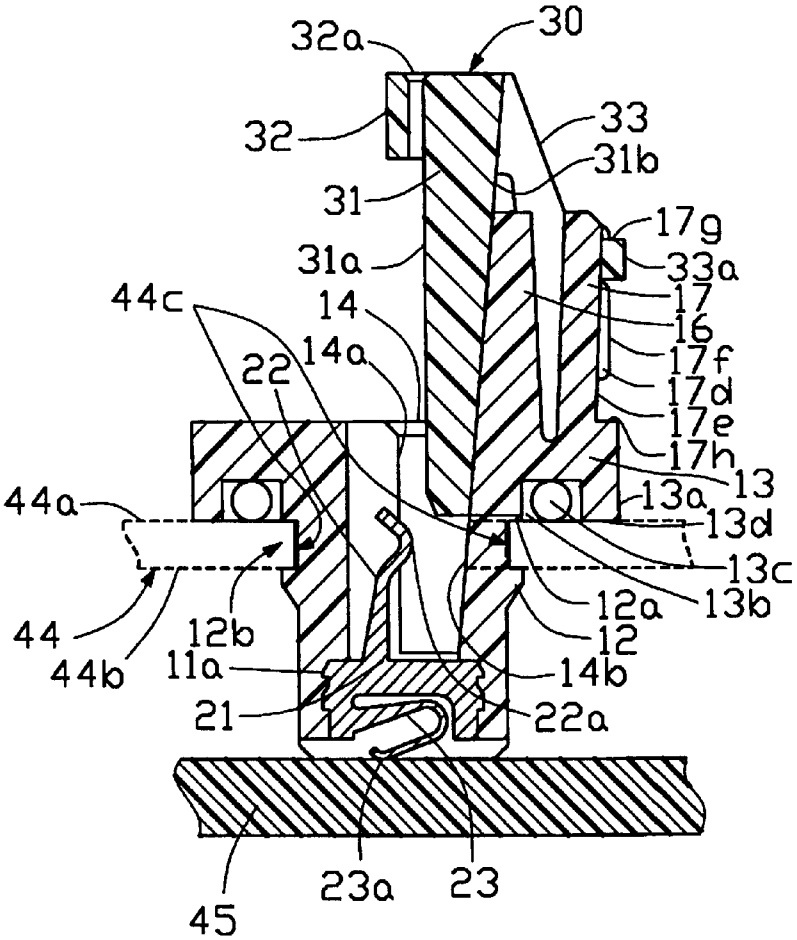
FIGS. 3A to 3D are cross sectional views showing displacement of a plunger of the compress header connector.
Figure 3A:
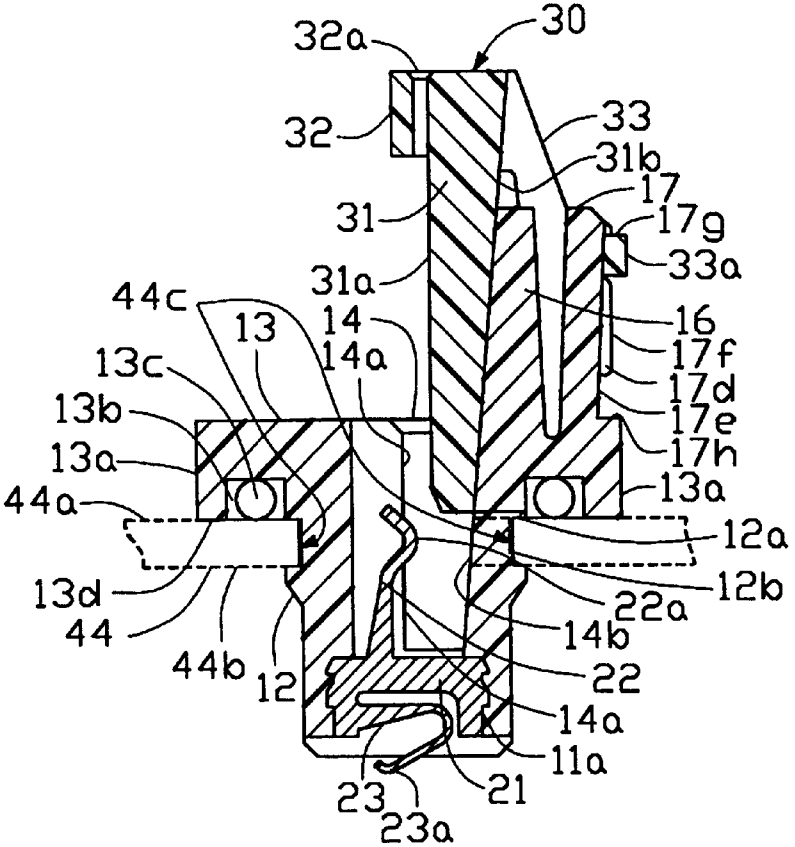

Referring to FIGS. 1, 2A, 2B, and 3A, a ZIF compression header connector 1 in accordance with the present invention comprises a housing 10 having upper and lower faces 10*a*, 10*b*. A plurality of terminal cells 11 is defined between the first and second faces 10*a*, 10*b*. Each terminal cell 11 defines a retaining chamber 11*a* adjacent to the lower face 10*b*. Six retaining wedges 12 and shoulders 12*a* are formed on outer walls of the housing 10 thereby defining retaining slots 12*b* therebetween. The housing 10 further forms flanges 13 extending from the upper face 10*a*. Peripheral skirts 13*a* extend from the flanges 13 and define a groove 13*b* for receiving a sealant 13*c* therein. A lower end 13*d* of the flange 13 is formed to be flush with the shoulder 12*a*. An elongate slot 14 is defined in the upper face 10*a* in communication with the terminal cells 11. The elongate slot 14 has a vertical wall 14*a* and an inclined wall 14*b* opposite the vertical wall 14*a*. A supporting wall 16 having an inclined face 16*a* flush with the inclined wall 14*b* extends from the housing 10. A retaining plate 17 extends parallel to the supporting wall 16 and is separated therefrom. The retaining plate 17 forms a chamfered end 17*a*, two limiters 17*b* adjacent to the chamfered end 17*a* and three spaced ribs 17*c*. Two hump portions 17*d* are arranged between the ribs 17*c* and outer surfaces 17*f* of the hump portions 17*d* project beyond outer surfaces 17*e* of the ribs 17*c*. The outer faces 17*f* of the hump portions 17*d* are offset from the outer faces 17*e* of the ribs 17*c*. First and second positions 17*g*, 17*h* are formed on opposite sides of each hump portion 17*d*. The housing 10 further defines recesses 18 in opposite ends thereof for receiving grounding clips 18*a* therein.

A plurality of terminals 20 is assembled in the corresponding terminal cells 11. Each terminal 20 includes a base portion 21 retained within the retaining chamber 11*a* of the terminal cell 11, a first spring arm 22 and a second spring arm 23 opposite the first spring arm 22. The first spring arm 22 includes a contact end 22*a* extending into the elongate slot 14. The second spring arm 23 includes a contact end 23*a* extending beyond the lower face 10*b*.

A plunger 30 is assembled to the housing 10 for facilitating electrical connection between an inserted FPC 40 and the terminals 20 of the housing 10. The plunger 30 includes a tongue 31 extending into the elongate slot 14 of the housing 10. The tongue 31 includes a first face 31*b* for supporting the inserted FPC 40 and a second face 31*a* for abutting against the inclined wall 14*b* of the elongate slot 14. The plunger 30 includes a dam 32 having an entrance slot 32*a* flush with the first face 31*b* of the tongue 31 on one side thereof for facilitating insertion of the FPC 40. The plunger 30 includes a retaining lug 33 for engaging with the retaining plate 17 of the housing 10. The retaining lug 33 includes a retaining bar 33*a* for abutting against the ribs 17*c* of the retaining plate 17. The retaining lug 33 is cantilevered from the plunger 30 thereby providing flexibility when engaging with the retaining plate 17.

Figure 3D:
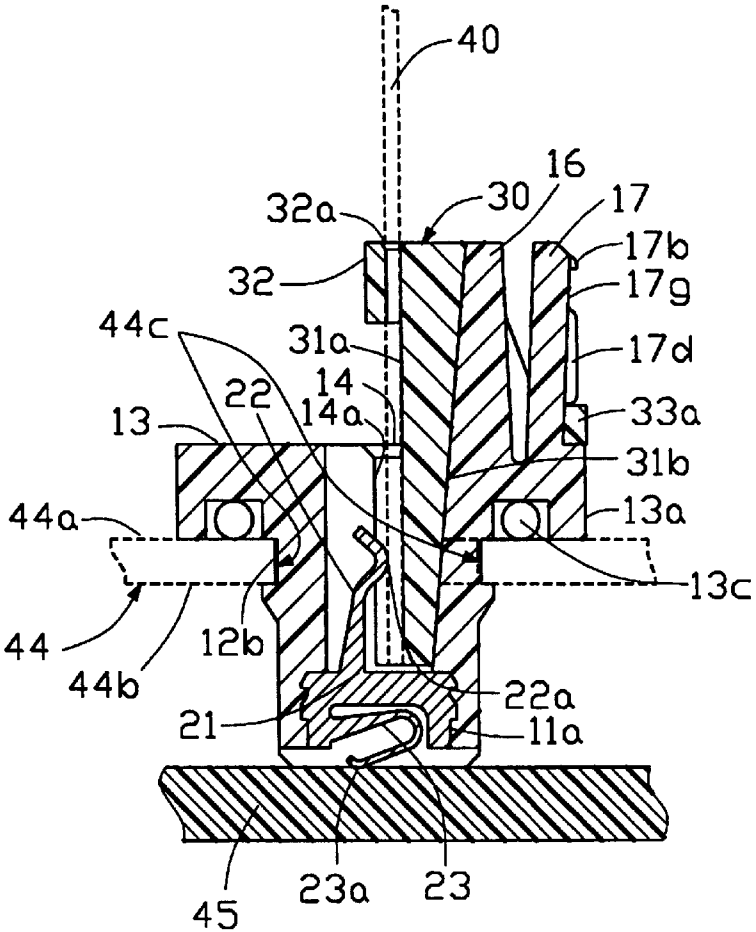
Figure 3C:
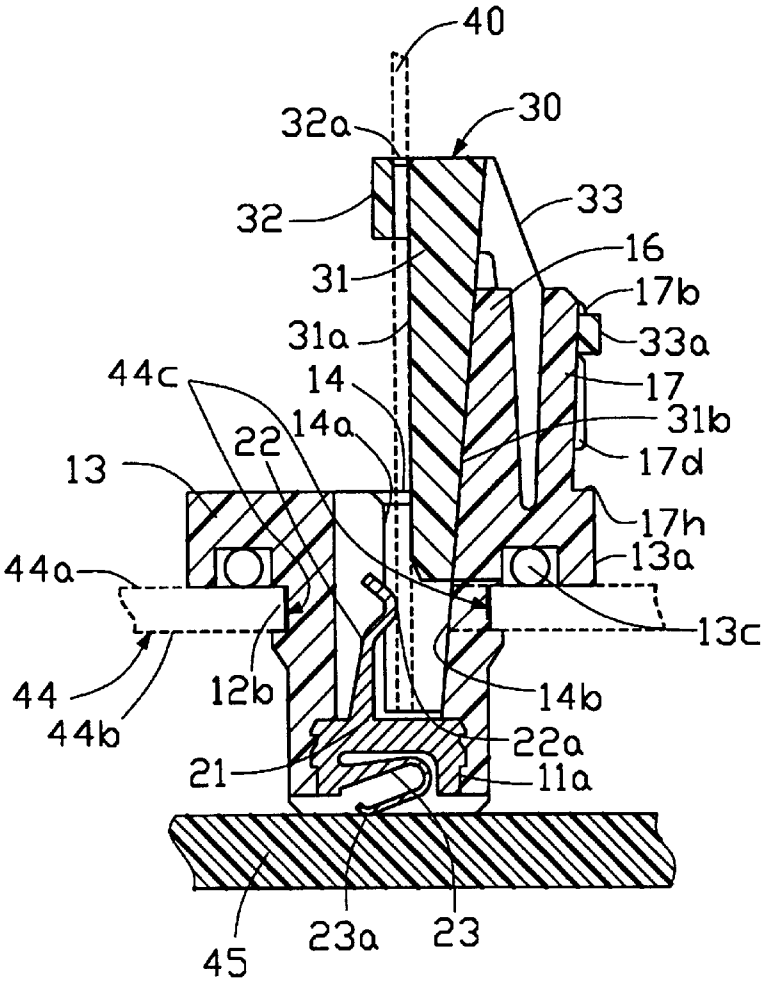

Referring to FIGS. 3A to 3D, in assembly the housing 10 is inserted into an opening 44*c* of a frame 44 of a hard disk drive (not labeled) whereby the peripheral skirts 13*a* and the shoulders 12*a* abut against an upper face 44*a* of the frame 44 while the retaining wedges 12 abut against a lower face 44*b* of the frame 44. Sealant 13*c* is deployed into the groove 13*b* for providing an airtight engagement between the housing 10 and the frame 44. In addition, the contact end 23*a* of the second spring arm 23 electrically abuts against a printed circuit board 45 located within the hard disk drive. The retaining bar 33*a* of the retaining lug 33 is facilitated by the chamfered ends 17*a* to slide over the limiters 17*b* to be located at the first position 17*g*. The FPC 40 is inserted into the elongate slot 14 through the entrance slot 32*a* of the plunger 30 and slides along the first face 31*b*. When the FPC

40 is completely inserted, conductors of the FPC 40 slightly abut against the contact ends 22*a* of the first spring arms 22. When the plunger 30 is moved downward, the retaining bar 33*a* slides over the outer surfaces 17*f* of the hump portions 17*d* and reaches the second position 17*h*. Since the inclined second face 31*a* of the tongue 31 slides along the inclined wall 14*b* of the elongate slot 14, the first face 31*b* urges the inserted FPC 40 against the contact ends 22*a* of the first spring arms 22 thereby establishing reliable connection between the inserted FPC 40 and the terminals 20.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A ZIF compression header connector comprising:

a housing having first and second faces, a plurality of terminal cells formed between the first and second faces, at least a retaining wedge formed on an outer wall of the housing for retaining the connector to a frame of a hard disk drive, the housing further forming flanges extending from the second face and forming a peripheral skirt, a groove defined between the peripheral skirt and the outer wall of the housing for receiving sealant therein, an elongate slot formed in the second face;

a plurality of terminals assembled in corresponding terminal cells, each terminal including a base portion retained within a corresponding terminal cell, a first spring arm extending into the elongate slot, and a second spring arm extending opposite the first spring arm for electrically contacting a conductive pad; and a plunger assembled to the housing for urging an inserted FPC against the first spring arms.

2. The compression header connector as recited in claim 1, wherein the plunger includes a tongue extending into the elongate slot for urging the FPC against the first spring arms.

3. The compression header connector as recited in claim 2, wherein the tongue includes a first face for supporting the inserted FPC and a second face for abutting against an inner wall of the housing.

4. The compression header connector as recited in claim 2, wherein the plunger includes a dam having an entrance slot for insertion of the FPC.

5. The compression header connector as recited in claim 4, wherein the entrance slot of the dam is flush with the first face of the tongue.

6. The compression header connector as recited in claim 1, wherein the plunger includes at least a retaining lug for engaging with the housing.

7. The compression header connector as recited in claim 6, wherein the housing forms a retaining plate for retaining the retaining lug.

8. The compression header connector as recited in claim 7, wherein the retaining plate forms a hump portion defining a first position at which the plunger is initially inserted into the elongate slot of the housing and a second position at which the plunger is fully inserted.

9. The compression header connector as recited in claim 1, wherein a contacting end of the first spring arm extends into a path of insertion of the FPC.

* * * * *